US006680664B2

(12) United States Patent
Fan

(10) Patent No.: US 6,680,664 B2
(45) Date of Patent: Jan. 20, 2004

(54) FERRITE CORE STRUCTURE FOR SMD AND MANUFACTURING METHOD THEREFOR

(76) Inventor: Yun-Kuang Fan, No. 9, Gau Cherng 9 St., Sec. 1, Ba Der City, Taoyuan Hsien (TW)

( * ) Notice: Subject to any disclaimer, the term of this patent is extended or adjusted under 35 U.S.C. 154(b) by 36 days.

(21) Appl. No.: 10/151,145

(22) Filed: May 21, 2002

(65) Prior Publication Data

US 2003/0218526 A1 Nov. 27, 2003

(51) Int. Cl.[7] ..... H01F 5/00

(52) U.S. Cl. ..... 336/83; 336/200; 336/65; 336/192; 29/602.1

(58) Field of Search ..... 336/65, 200, 192, 336/209, 210; 29/602.1

(56) References Cited

U.S. PATENT DOCUMENTS 6,157,283 A * 12/2000 Tsunemi ..... 336/192
6,292,083 B1 * 9/2001 Tajima et al. ..... 336/192
6,535,094 B2 * 3/2003 Murata et al. ..... 336/83
6,566,993 B1 * 5/2003 Otsuka et al. ..... 336/83

FOREIGN PATENT DOCUMENTS

JP 40728821 A * 10/1995

* cited by examiner

*Primary Examiner*—Anh T Mai
(74) *Attorney, Agent, or Firm*—Rosenberg, Klein & Lee

(57) ABSTRACT

A ferrite core structure and manufacturing method therefor comprise a ferrite core having gaps at both ends and located on fastening terminals, which are formed symmetrically, at both ends of the conductive bracket, and a pair of insulating seats being shaped at each end of the ferrite core column via the transfer molding technology, a conductive coil being wound on the portion of the ferrite core column which is not enclosed by the insulating seats while both ends of the coil is soldered. In this way, a coil type inductor element applied to a surface-mounted device (SMD) is got. According to the process of the present invention, not only the complicated process steps of commonly arts are simplified but also mass production is easier. Meanwhile, when the present invention is used, the configuration of space is more flexible.

5 Claims, 6 Drawing Sheets

FERRITE CORE STRUCTURE FOR SMD AND MANUFACTURING METHOD THEREFOR

BACKGROUND OF THE INVENTION

1. Field of the Invention

The present invention relates to a ferrite core structure for surface-mounted device (SMD) especially to a new one which comprises of a ferrite core having gaps at both ends thereof and a conducting bracket and is manufactured by a new method applying transfer molding technology and punching technology.

2. Description of the Prior Art

Commonly used ferrite cores and manufacturing methods therefor are illustrated in FIG. 1 (A). In the figure, Ag-Pd alloy is electroplated at the bottom surface 811 of the ferrite core to form two electrodes 812, and the two ends 821 of the coil 82 wound on the ferrite core 81 are soldered to be fastened. The main disadvantages of the above-mentioned art are that Ag and Pd are expensive; electroplating waste water purification is so difficult that the cost is too high and ecology may suffer from serious damage if the waste water is not purified well.

Another prior art of a ferrite core structure 9 for SMD is to wind a coil 92 on the shaped ferrite core 91, and then to glue the ferrite core 91 to a base 93 having conductive electrodes 931 with glue, as shown in FIG.1(B) and FIG.1 (C). The ferrite core manufactured in the above-mentioned process can keep Ag and Pd off, however, increasing base makes the process more complicated, and increases the volume and height such that manufacturing cost is not easy to be controlled.

According to the disadvantages of the prior arts described above, the inventor of the present invention ever proposed an improved art (please refer to Taiwan Patent No.458351, as shown in FIG.1 (D)), which effectively improves the disadvantages of prior arts, such as promoting mass production, lowering cost, circumstance protection, etc. However, the ferrite core of the art is essential to be adhered vertically to set such that it is not easy to be applied to light, thin and small-size electrical products due to the difficult of having suitable space. Thus the art still has an obvious disadvantage.

Besides, related prior arts can be referred to in JP Patent No.5-198438, which has the manufacturing process and composition similar to characteristics of the ferrite core for SMD. However, the disadvantages and defects of the art are described as follows:

1. Complicated manufacturing process- The ferrite core has to be manufactured during complicated sintering process and several times of lathing work. Besides, the lathed ferrite core has different roundness, which may cause changes in characteristic such that the quality can not be perfectly controlled.

2. Difficulty of Mass manufacture- The quality has to be kept according to manual work because of the complicated process. Therefore, continuous mass manufacture can't be performed.

3. Molding problems- The ferrite core is molded after manufactured and thus the electric characteristic of the part is reduced.

4. The restrict of volume- Because the volume of the part can't be reduced, there are some scruples and restrictions in applications.

5. High cost- Because the process is complicated and mass production is difficult, the manufacture cost is increased heavily.

Therefore, the commonly used structure and related process still have many disadvantages and really are not perfect designs such that improvement is required.

The inventor of the present invention ruminated over the disadvantages resulted from the commonly used ferrite core structures for SMD and manufacturing methods therefor, and earnestly deliberated the way of improvement and innovation. After studying hard for a long period, the inventor eventually succeeded in inventing the present invention, a new ferrite core for SMD and manufacturing method therefor.

SUMMARY OF THE INVENTION

The first purpose of the present invention is to provide a ferrite core structure for SMD, wherein two conductive terminals are revealed, and bended to parallel to the surface of the two insulating seats at both end portions symmetrically. In this way, the ferrite core structure can be placed horizontally relative to other parts to use such that the configuration of space can be more flexible.

The second purpose of the present invention is to provide a ferrite core structure for SMD and manufacturing method therefor, whereof the process of the present invention is simplified and manufacturing steps are reduced such that mass production is easier.

The third purpose of the present invention is to provide a ferrite core structure for SMD and manufacturing method therefor, wherein a ferrite core having gaps at both ends and a conducting bracket are used, and transfer molding technology and punching technology are used to manufacture the present invention such that electroplating process is avoided to protect the circumstance.

The ferrite core structure for SMD and manufacturing method therefor which can achieve the above-mentioned purposes is manufactured in following way. First, the conductive pieces extending from the conducting bracket are inset into the ferrite core column in advance. Then the transfer molding technology is utilized to form insulating seats at both ends of the ferrite core column. Finally, a coil-wound type inductor element is completed after the coil are wound on the portion of ferrite core without being enclosed by the insulating seat, and two ends thereof are soldered. According to the process of the ferrite core provided from the present invention can not only simplify the complicated process and manufacturing steps in commonly used arts but also promote mass production. Besides, the configuration of the space can be more flexible when the present invention is applied.

BRIEF DESCRIPTION OF THE DRAWINGS

The drawings disclose an illustrative embodiment of the present invention which serves to exemplify the various advantages and objects hereof, and are as follows:

FIG.2 (B) is the explosion diagram of the ferrite core structure for SMD of the present invention;

DETAILED DESCRIPTION OF THE PREFERRED EMBODIMENT

Figure 1A:
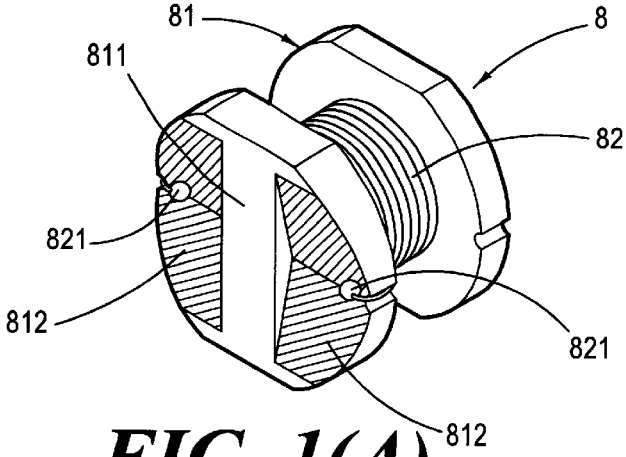
FIG. 1(A) PRIOR ART
FIG.1 (A)~(D) are schematic diagrams of the commonly used ferrite core structures.
Figure 1B:
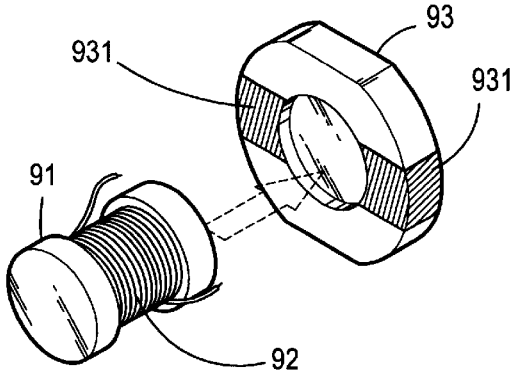
FIG. 1(B) PRIOR ART
Figure 1C:
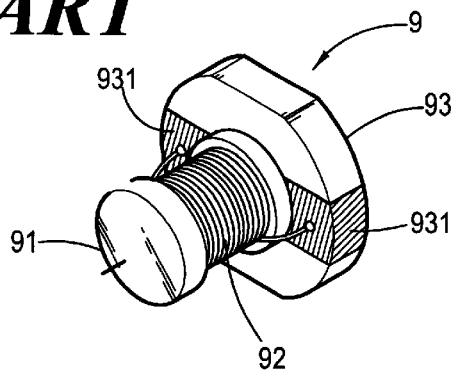
FIG. 1(C) PRIOR ART
Figure 1D:
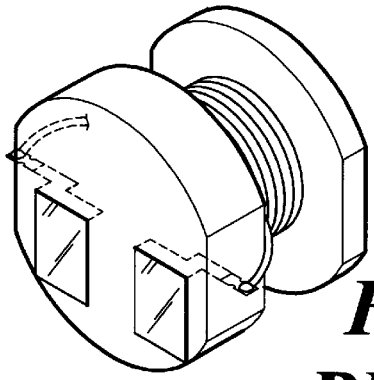
FIG. 1(D) PRIOR ART
Figure 2A:
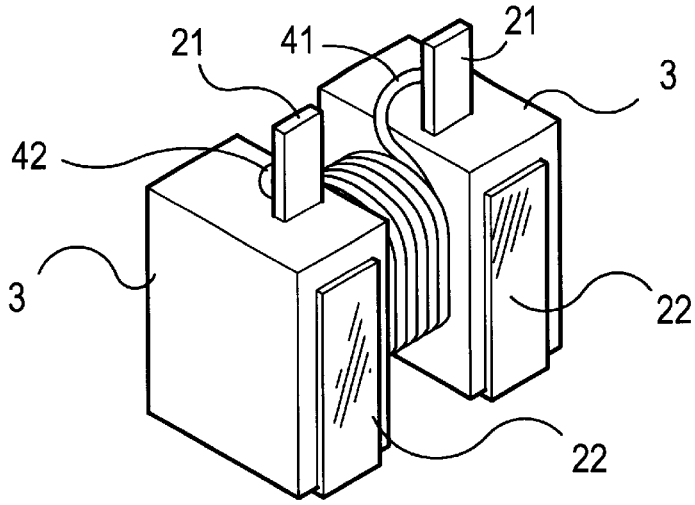
FIG.2 (A) is the three-dimensional diagram of the ferrite core structure for SMD of the present invention.
Figure 2B:
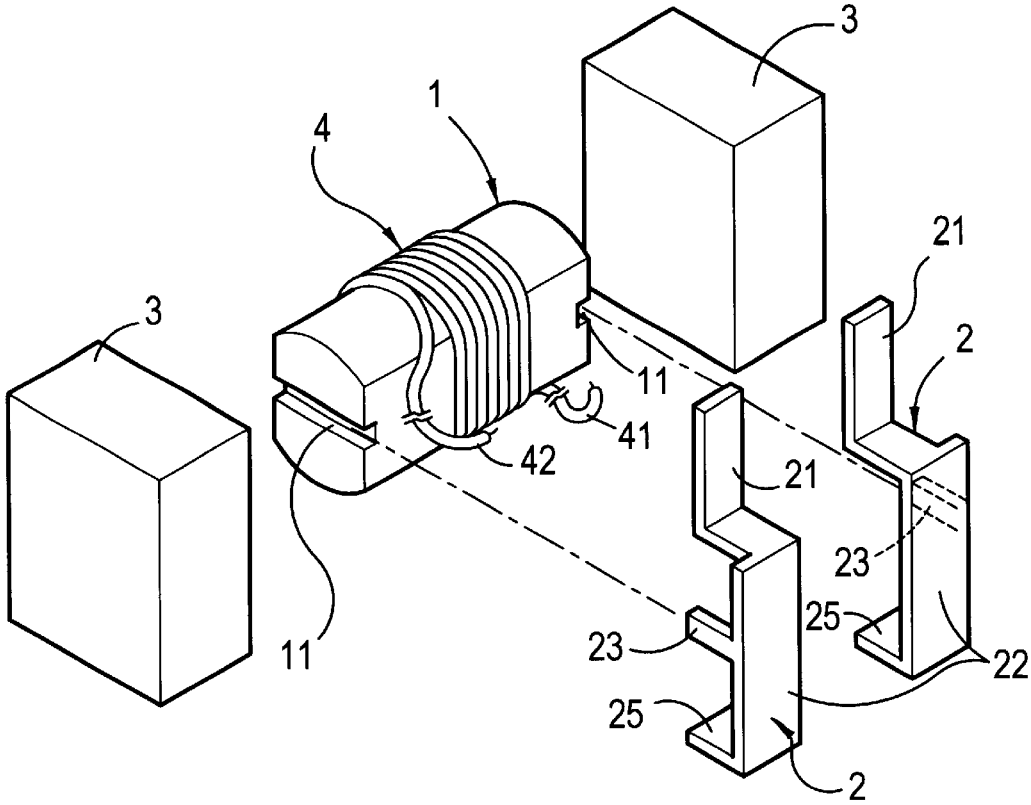
Figure 3B:
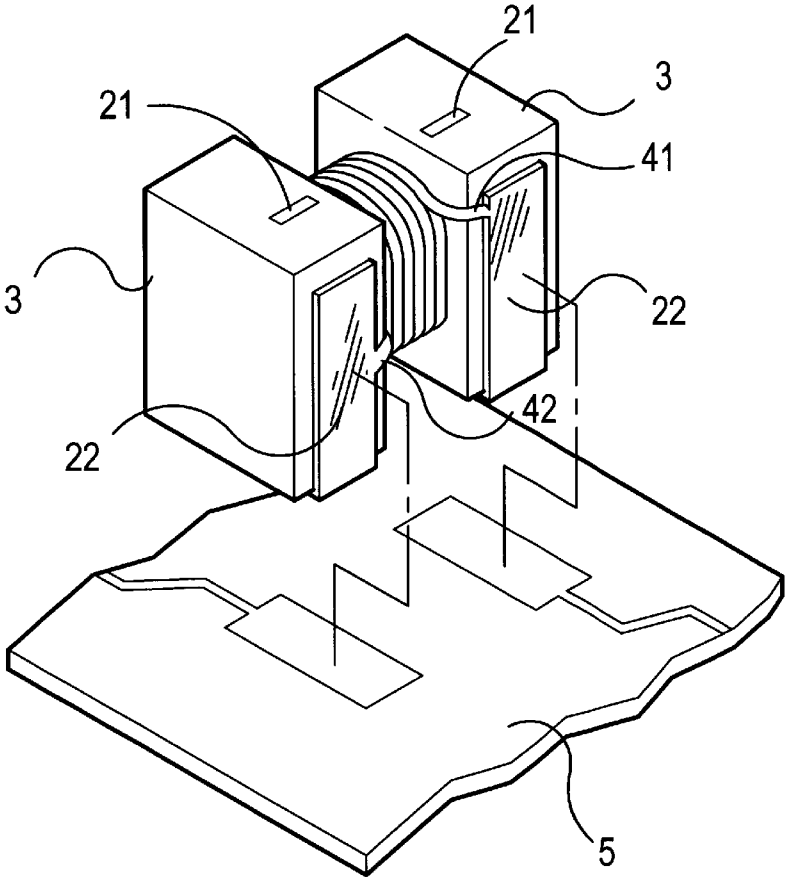
FIG.3 is exemplary diagram of the ferrite core structure for SMD.
Figure 3A:
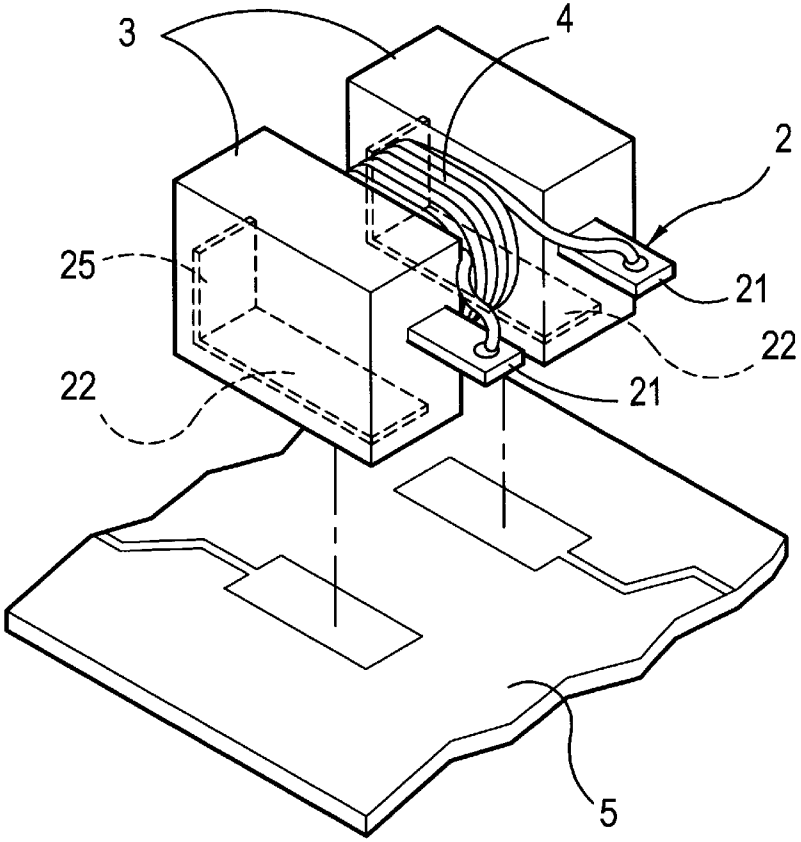
Figure 4A:
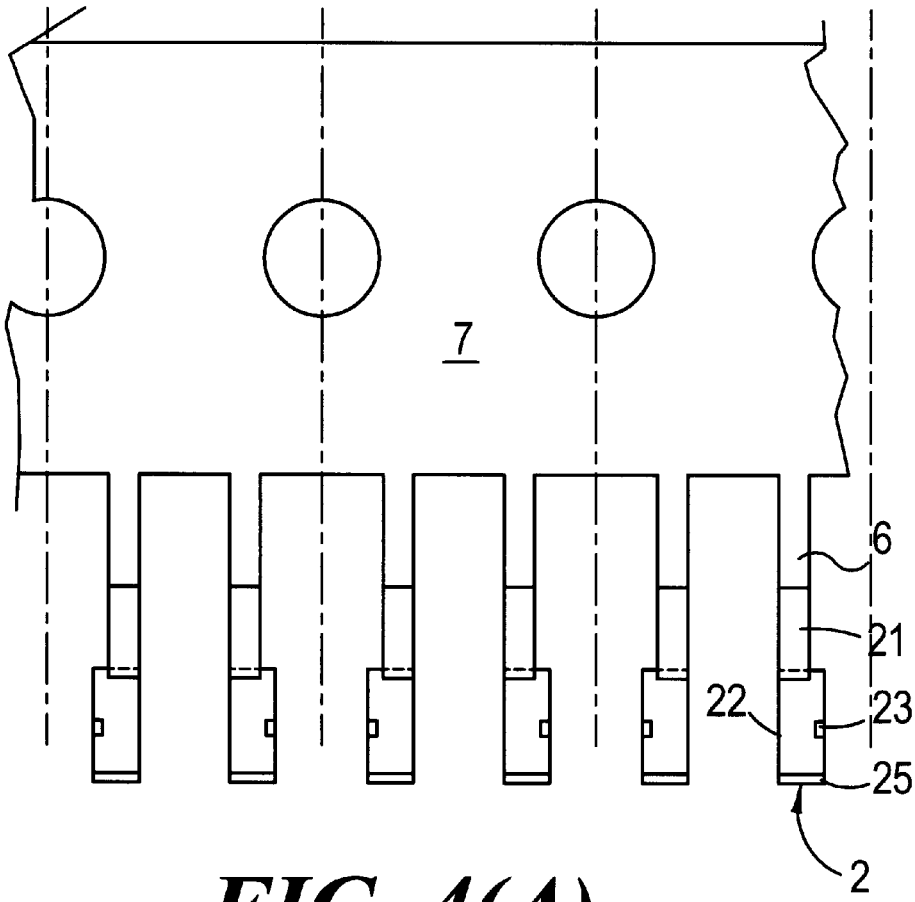
FIG.4 (A)~(B) are schematic diagrams of manufacturing method of the ferrite core structure for SMD with setting a conducting bracket.
Figure 4B:
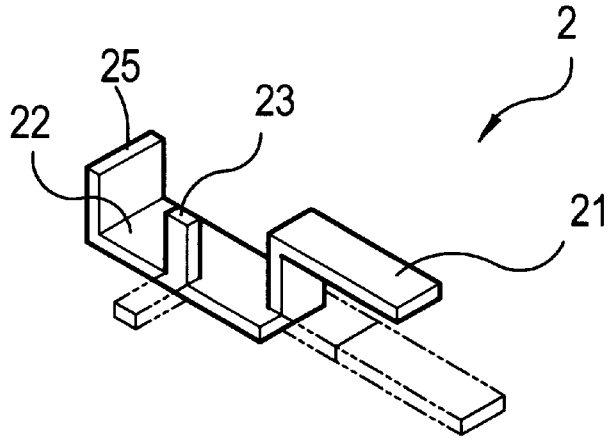
Figure 5A:
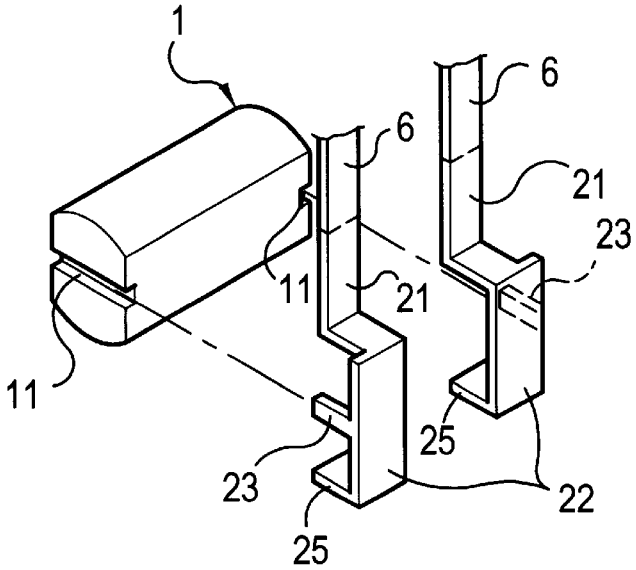
FIG.5 (A)~(D) are diagrams of the process of the manufacturing method of the ferrite core for SMD.
Figure 5B:
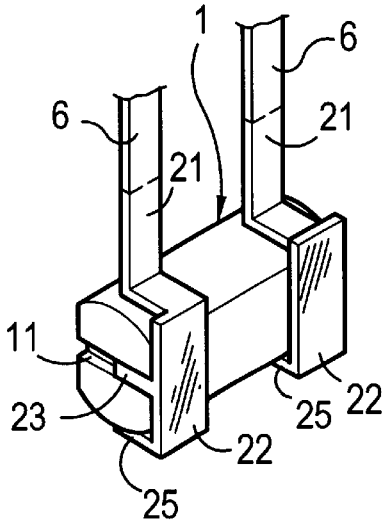
Figure 5C:
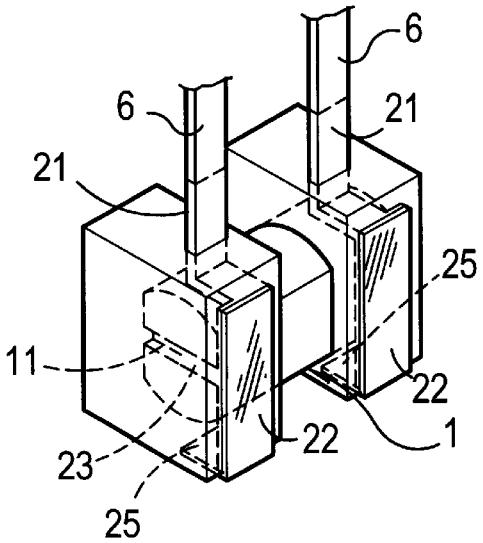
Figure 5D:
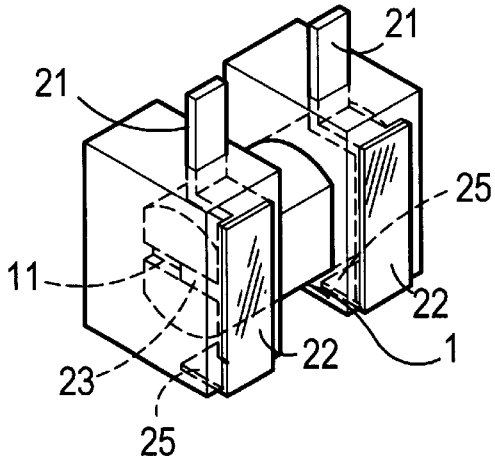
Figure 6B:
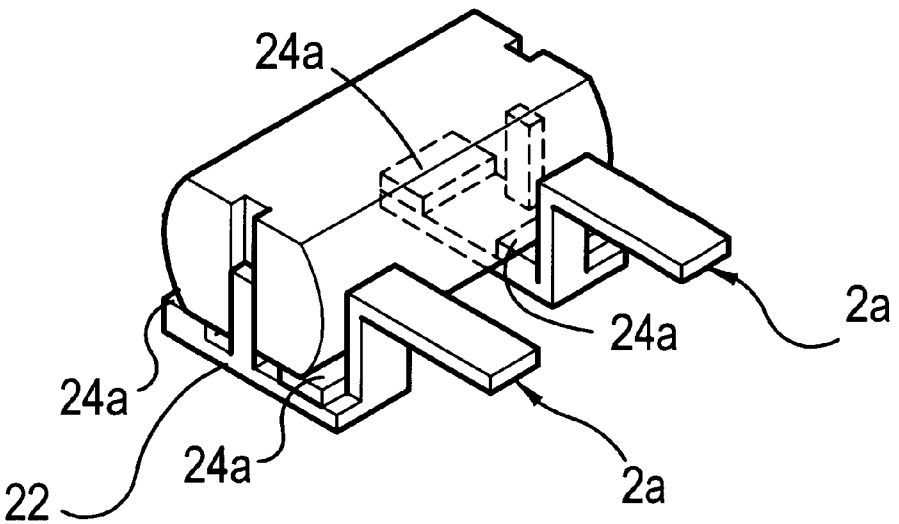
FIG.6 (A)~(B) are perspective embodiments of the prevent invention.
Figure 6A:
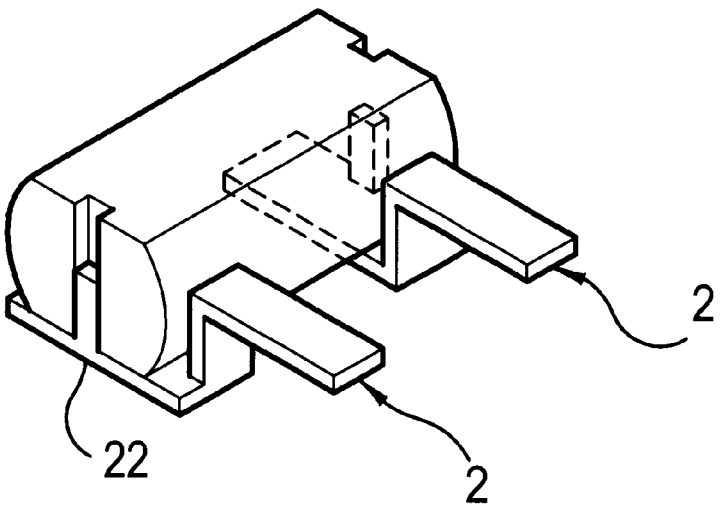

Please refer to FIG.2 (A), (B), which illustrate the ferrite core structure for SMD of the present invention. The ferrite core structure is mainly composed of a ferrite core column 1, two conductive pieces 2, two insulating seat 3 and a conductive coil 4. A gap 11 is set at each end portion of the ferrite core column 1. One end of the conductive piece 2 is a connecting terminal 21 while the other end is extended to form a conductive terminal 22 and a fastening terminal 23. The conductive terminals 22 can be extended and bent to form a holding part 25. The fastening terminal 23 can be inset into the gap 11 of the ferrite core 1. The two insulating seats 3 are respectively set at both ends of the ferrite core column 1 to enclose the ferrite core column 1 such that only the conductive terminals 22, the connecting terminals 21 and the holding part 25 of two conductive pieces 2 set on the ferrite core column 1 are revealed at lateral side of the insulating seat 3. The conductive coil 4 can be wound on the portion of the ferrite core which is not enclosed by the insulating seat 3. The two terminals 41 and 42 of the conductive coil 4 are respectively connected to the connecting terminals 21 of the two conductive pieces 2. FIG.3 illustrates that the ferrite core can be set horizontally on the base board 5(as a circuit board) to reduce occupied area such that the configuration of the whole space is more flexible.

Referring to FIG.4(A)~(B) and FIG.5(A)~(D), the manufacturing method of the ferrite core for SMD of the present invention comprises at least following steps:

Step1: Fastening terminals 23 of two symmetrical conductive pieces at the end of the conducting bracket unit 6 are inset into the two gaps 11 of the ferrite core column 1.

Step2: A pair of insulating seats 3 are respectively shaped at two end of the ferrite core column 1 by the transfer molding process and only the conductive terminals 22, the connecting terminals 21 and the holding part 25 of the conductive pieces 2 are revealed at the lateral side of the insulating seats. When the insulating seat 3 is enclosed, the holding part 25 can hold the relative position between the ferrite core column 1 and the conductive piece 2 such that movement and breaking away to each other can be avoided to occur.

Step3: By the punching process, the ferrite core column 1 enclosed by the insulating seats 3 at both ends are punched to depart from the conducting bracket unit 6.

Step4: A conductive coil is wound on the portion of the ferrite core 1 which is not enclosed by the insulating seats 3, and the two terminals 41, 42 of the conductive coil 4 are connected to the connecting terminals 21 of the two conductive pieces 2.

Step5: The two connecting terminals 21 revealed at the insulating seats 3 are bended to parallel to the surface of the insulating seats 3 symmetrically.

Step6: The ferrite core structure for SMD of the present invention is got.

In particular, the manufacturing method of the present invention applies the conducting bracket which can be extended repetitively as shown in FIG.4 which illustrates a conducting bracket set composed of several conducting bracket units 6 abreast. In this way, mass production of the ferrite core of the present invention can be higher in manufacturing speed and lower in manufacturing cost.

In comparison with other commonly used arts, the ferrite core structure for SMD of the present invention and the manufacturing method therefor have the following advantages:

(1) With the manufacturing method of the present invention, the process is simple and mass production is easier such that the cost is reduced.

(2) Electroplating technology can be avoided to protect circumstance.

(3) According to the feature that the ferrite core structure of the present invention occupies smaller space such that the configuration of space of related electrical parts is more flexible.

Many changes and modifications in the above described embodiment if the invention can, of course, be carried out without departing from the scope thereof. Accordingly, to promote the progress in science and the useful arts, the invention is disclosed and is intended to be limited only by the scope of appended claims.

What is claim is:

1. A ferrite core structure for SMD, which comprises:

a ferrite core column, wherein a pair of gaps are set at each end portion of both sides;

a pair of conductive pieces, wherein a first end of said conductive pieces is a connecting terminal while a second end is extended and shaped to be formed a conductive terminal and a fastening terminal, said fastening terminal enabling to be inset into said gaps of said ferrite core column;

a pair of insulating seats, which are respectively enclosed at both ends of said ferrite core column, said conductive terminals, said connecting terminals of said conductive pieces and a holding part being revealed at a lateral side of said insulting seats;

a conductive coil being wound on said ferrite core column, both ends being respectively connected to said connecting terminals of said conductive pieces.

2. The ferrite core structure for SMD as recited in claim 1, wherein said connecting terminals are revealed and bended to be parallel to a surface of said insulating seats of said ferrite core structure symmetrically.

3. The ferrite core structure for SMD as recited in claim 1, wherein both ends of said core can be respectively connected to said conductive terminals of said conductive pieces.

4. The ferrite core structure for SMD as recited in claim 1, wherein said conductive terminal has a holding part used for positioning said conductive pieces accurately with respect to said ferrite core.

5. A manufacturing method of said ferrite core structure as recited in claim 1, which at least comprises following steps:

step1: said connecting terminals of said conductive pieces at an end of a conducting bracket unit being inset into said gaps of said ferrite core column;

step2: said pair of insulating seats are respectively shaped at both ends of said ferrite core column by a transfer molding process and only said conductive terminals, said connecting terminals of said conductive pieces and said holding part being revealed at said lateral side of said insulating seat step3: with a punching process, said ferrite core column enclosed by said insulating seat at both ends being punched to depart from said conducting bracket unit;

step4: said conductive coil being wound on a portion of said ferrite core which is not enclosed by said insulating seats, and said two terminals of said conductive coil being connected to said connecting terminals of said two conductive pieces;

step5: said two connecting terminals revealed at said insulating seats being bended to parallel to said surface of said insulating seats symmetrically.

* * * * *